US010271695B2

(12) United States Patent
Keily et al.

(10) Patent No.: US 10,271,695 B2
(45) Date of Patent: Apr. 30, 2019

(54) PAPER TOWEL DISPENSER DAMPING SYSTEM

(71) Applicant: DISPENSING DYNAMICS INTERNATIONAL, City of Industry, CA (US)

(72) Inventors: Joel P. Keily, Corona, CA (US); Alexander Trampolski, Eastvale, CA (US); Charles Parkin Davis, Torrance, CA (US)

(73) Assignee: Dispensing Dynamics International, LLC, City of Industry, CA (US)

( * ) Notice: Subject to any disclaimer, the term of this patent is extended or adjusted under 35 U.S.C. 154(b) by 237 days.

(21) Appl. No.: 15/292,543

(22) Filed: Oct. 13, 2016

(65) Prior Publication Data

US 2017/0105588 A1 Apr. 20, 2017

Related U.S. Application Data

(60) Provisional application No. 62/242,456, filed on Oct. 16, 2015.

(51) Int. Cl.
*A47K 10/34* (2006.01)
*A47K 10/36* (2006.01)

(52) U.S. Cl.
CPC ..... *A47K 10/34* (2013.01); *A47K 10/3643* (2013.01); *A47K 10/3656* (2013.01); *A47K 2010/3675* (2013.01)

(58) Field of Classification Search
CPC .... A47K 10/34; A47K 10/38; A47K 10/3643; A47K 10/3656; A47K 10/3612; A47K 2010/2375; A47K 2010/3233; A47K 2010/3863; A47K 10/3675; B65H 23/022; B65H 23/025; B65H 23/0251; B65H 23/0258; B65H 23/035; B65H 23/038; B65H 23/04; B65H 16/10; B65H 10/103; B65H 16/106; B65H 16/021; B65H 16/023; B65H 16/02; B65H 16/005; B65H 20/02; B65H 2701/1924; B65H 26/16; B65H 35/002; B65H 35/10; B65H 75/002; B65H 49/203; B65H 49/20; B65H 49/24; B65H 49/26
USPC ..... 242/560, 560.1, 564, 564.2, 564.4, 423
See application file for complete search history.

(56) References Cited

U.S. PATENT DOCUMENTS 3,918,661 A * 11/1975 Kishi ..... A47K 10/38 242/422.5
5,441,189 A * 8/1995 Formon ..... B26F 1/20 225/106
6,363,824 B1 * 4/2002 Granger ..... A47K 10/3643 242/560
6,460,798 B1 * 10/2002 Haen ..... A47K 10/3687 242/560
6,474,591 B1 * 11/2002 Granger ..... A47K 10/3687 242/560
6,497,167 B1 * 12/2002 Granger ..... A47K 10/3643 83/337

(Continued)

*Primary Examiner* — Michael R Mansen
*Assistant Examiner* — Raveen J Dias
(74) *Attorney, Agent, or Firm* — Thomas R. Lampe

(57) ABSTRACT

A paper toweling dispenser apparatus including damping structure for taking up over-spin slack, including a pivoting paper guide pivotally connected to a fixed paper guide by springs which operate in sequential stages during paper toweling dispensing.

8 Claims, 4 Drawing Sheets

(56) References Cited

U.S. PATENT DOCUMENTS

| | | | | |
|---|---|---|---|---|
| 7,500,420 | B2 * | 3/2009 | Cvjetkovic | A47K 10/38 83/649 |
| 8,162,252 | B2 * | 4/2012 | Cittadino | A47K 10/36 242/560 |
| 9,854,948 | B1 * | 1/2018 | Paal | A47K 10/3631 |
| 2007/0079684 | A1 * | 4/2007 | Friesen | B26D 1/42 83/649 |
| 2008/0217350 | A1 * | 9/2008 | Hansen | A47K 10/3643 221/15 |
| 2011/0101151 | A1 * | 5/2011 | Hagleitner | A47K 10/3687 242/560.1 |
| 2014/0116216 | A1 * | 5/2014 | Morand | A47K 10/36 83/175 |
| 2015/0082960 | A1 * | 3/2015 | Niada | A47K 10/3643 83/203 |
| 2016/0262581 | A1 * | 9/2016 | Morand | A47K 10/3643 |

* cited by examiner

PAPER TOWEL DISPENSER DAMPING SYSTEM

This application is based on and claims the benefit of U.S. Provisional Patent Application No. 62/242,456, filed Oct. 16, 2015.

TECHNICAL FIELD

This invention relates to dispenser apparatus for dispensing paper toweling and more particularly to structure for damping forces applied to a roll of toweling when overspin slack is taken up. The term "paper toweling" as employed herein also encompasses tissue and the teachings of this invention are applicable to dispensing from rolls of paper tissue.

BACKGROUND OF THE INVENTION

The present invention addresses certain problems, including the problem of "tabbing" occurring during use of a paper towel dispenser. Tabbing occurs when a piece of towel tears off the sheet when a user grasps and pulls the paper. Tabbing may occur with one or two hand pulls. Papers that absorb water at the greatest rate are most likely to tab. The rate of water absorbency varies by paper manufacturer and grade. Premium grade papers tend to absorb water the quickest and are generally harder to cut which leads to a higher rate of tabbing.

It has been found that tabbing occurs when overspin slack is taken up and/or when a blade on the dispenser is utilized to cut the paper. A "shock" is present at the moment the overspin slack is exhausted. The shock occurs because the stationary roll towel must begin rotating at the moment that the overspin slack is exhausted. The shock is greatest with full rolls and diminishes as the roll is exhausted. U.S. Pat. No. 7,500,420, issued Mar. 10, 2009 discloses an approach for addressing the "tabbing" problem.

Another potential problem is the accumulation of toweling wrinkles caused by overspin which can interfere with cutting of the toweling.

DISCLOSURE OF INVENTION

The present invention deals with the problems of "tabbing" and toweling wrinkling, as well as reducing the chance of toweling accumulating on a toweling support roller during dispensing. The invention is characterized by its simplicity, reliability and effectiveness of operation.

In the invention, a damping nip roller is rotatably mounted on a pivoting paper guide of a paper guide assembly to dampen shock force that occurs when overspin slack is fully consumed. The paper guide assembly improves cutting by preventing accumulation of toweling wrinkles.

This arrangement also creates nearly 270 degrees of wrap on the toweling support roller which further improves the ability to cut a variety of toweling types by reducing chance for toweling to slip on the toweling support roller.

A two stage spring action is incorporated in the apparatus—coil springs and plastic springs. After initial damping begins, plastic springs that are integrated into the pivoting paper guide engage a fixed mechanism feature to apply additional spring force and increase damping.

Other features, advantages and objects of the present invention will become apparent with reference to the following description and accompanying drawings.

BEST MODE FOR CARRYING OUT THE INVENTION

Figure 7:
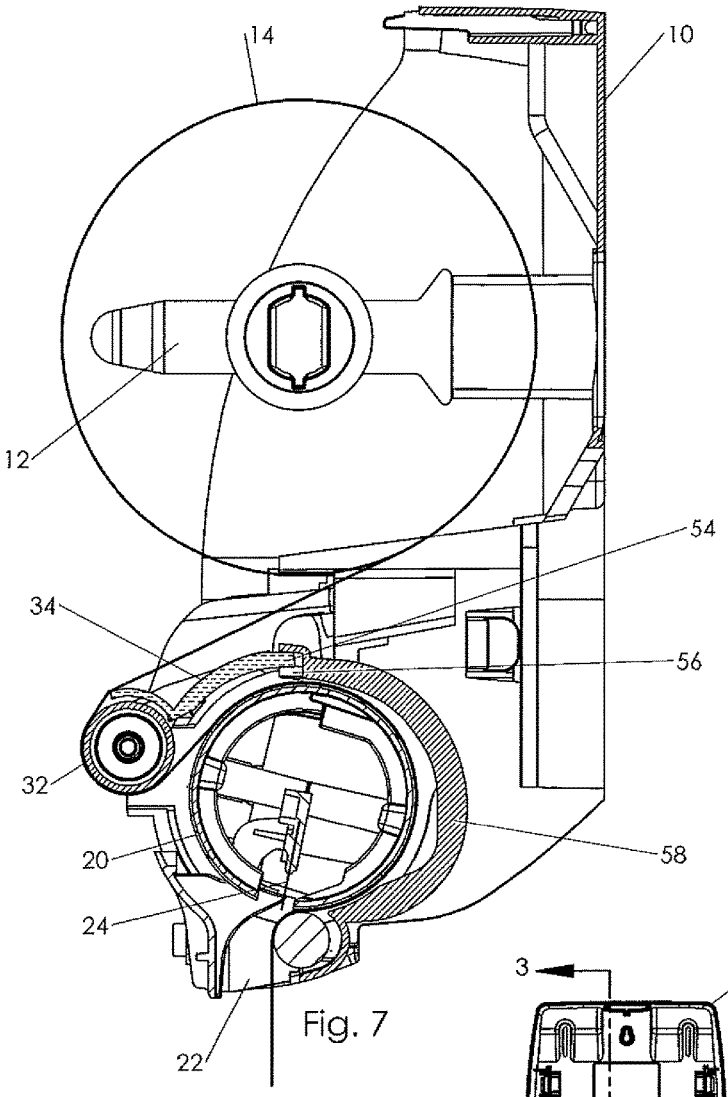
FIG. 7 is an enlarged, side sectional view showing toweling from a roll of toweling passing about the damping nip roller and about the toweling support roller to a dispenser exit, the damping nip roller and pivoting paper guide at a point of operation where plastic spring action of the damping assembly begins.
Figure 8:
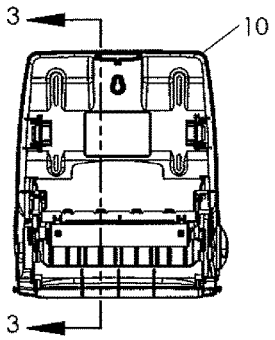
FIG. 8 shows the section view plane for FIGS. 3, 4 and 7.

Referring now to the drawings, a rear housing portion of a paper toweling dispenser incorporating the teachings of the present invention is illustrated, the housing portion being designated by reference numeral 10. As is conventional, the dispenser incorporates two support arms 12 which are used to rotatably support a roll of paper toweling to be dispensed. FIG. 7 illustrates a paper toweling roll 14.

As is also conventional, the illustrated toweling dispenser includes a toweling support roller 20 which rotates during the dispensing operation and the toweling exits a dispensing opening 22. In the arrangement illustrated a retractable cutter blade 24 is operatively associated with the toweling support roller similar to the arrangement disclosed in above-referenced U.S. Pat. No. 7,500,420.

Incorporated in the dispenser is a damping assembly which includes a damping nip roller 32 and a pivoting paper guide 34. The damping nip roller 32 is rotatably supported at the distal or outer end of the pivoting paper guide.

Figure 9:
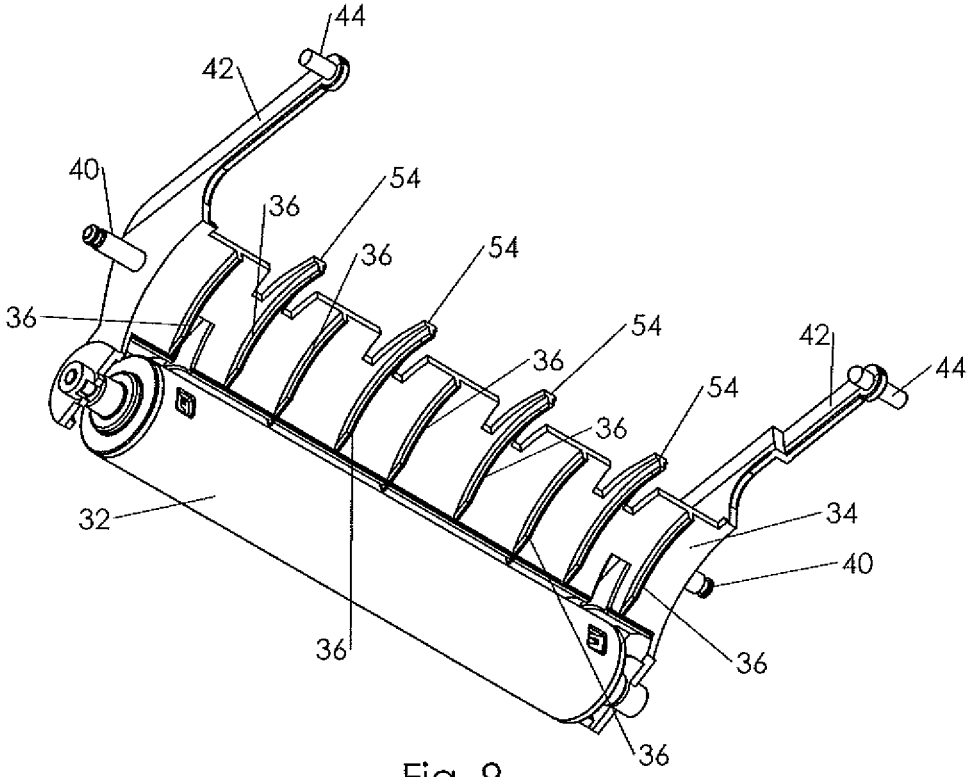
FIG. 9 is a perspective view of the damping nip roller and pivoting paper guide as viewed from underneath and illustrating paper guide ribs on the pivoting paper guide employed to create the paper path for the paper toweling about the toweling support roller.

As perhaps may best be seen with reference to FIG. 9, ribs 36 are located on the curved underside of the pivoting paper guide. Pivot pins 44 pivotally attach the pivoting paper guide 34 to side panels of the housing portion 10, the pivot pins positioned at the distal end portions of elongated members or arms 42 of the pivoting paper guide.

Figure 1:
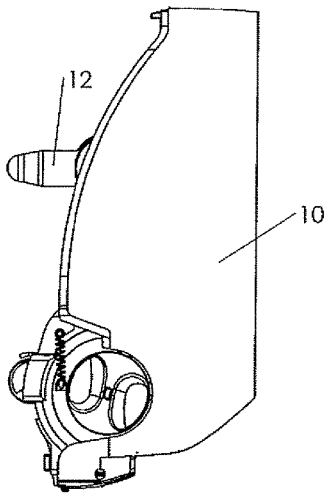
FIG. 1 illustrates a toweling support roller of a paper towel dispenser, a damping nip roller and pivoting paper guide of the paper guide assembly, the damping nip roller being in natural resting position against the toweling support roller.
Figure 3:
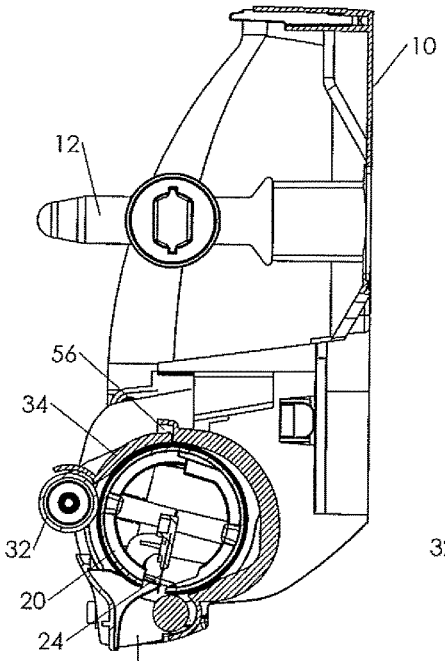
FIG. 3 is an enlarged, sectional view of the component arrangement of FIG. 1, as taken along the section plane 3-3 shown in FIG. 8.

Stub shafts 40 are attached to ends of coiled springs 46, the other ends of the springs 46 being connected to the housing portion 10. The springs 46 exert a downward force on the arms 42 and the pivoting paper guide 34 is biased so that the damping nip roller 32 engages paper toweling support roller 20 when no paper toweling is disposed therebetween. This is the condition shown in FIGS. 1 and 3 for example. When however a tensional force is exerted on the toweling between the damping nip roller and toweling support roller sufficient tension in the toweling will pivot the pivoting paper guide and raise the damping nip roller upwardly as shown in FIGS. 4 and 7, for example, so that it provides a damping action with respect to the paper toweling.

An inventive feature of this invention relates to the use of flexible plastic springs incorporated in the pivoting paper guide 34 to engage a fixed mechanism feature to apply additional spring force to the pivoting paper guide. FIG. 7 illustrates by means of an arrow the distal ends of the plastic springs 54 which in this embodiment are extensions of some of the ribs 36.

The distal ends of the plastic springs 54 are positioned in recesses 56 which are defined by a fixed paper guide 58. Fixed paper guide 58 is a component of the damping assembly of this invention, along with the damping nip roller 32 and pivoting paper guide 34. Fixed paper guide 58 is attached to the housing side panels. The pivoting paper guide isn't directly connected to the fixed paper guide until the plastic springs contact the fixed paper guide during the damping phase.

Figure 2:
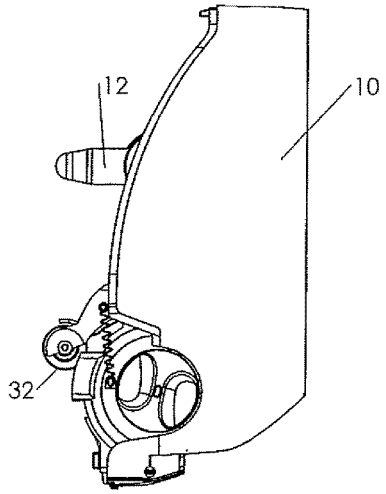
FIG. 2 is a view similar to FIG. 1, but illustrating the damping nip roller and pivoting paper guide at maximum travel position to provide maximum damping.
Figure 4:
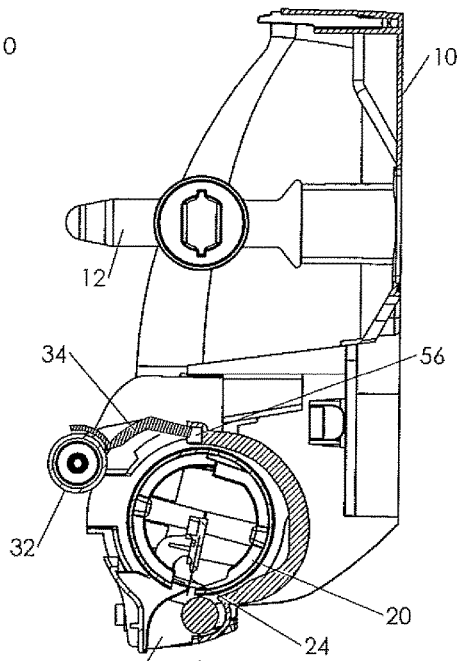
FIG. 4 is a view similar to FIG. 3, but illustrating the relative positioning of the damping nip roller and pivoting paper guide relative to the toweling support roller to provide maximum damping as illustrated in FIG. 2.
Figure 5:
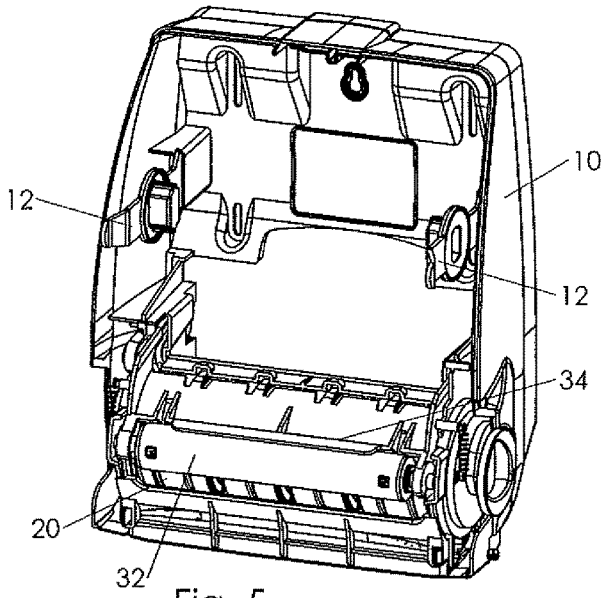
FIG. 5 is a frontal, perspective view of the rear housing portion of the paper towel dispenser illustrating the damping nip roller in the position shown in FIG. 1.
Figure 6:
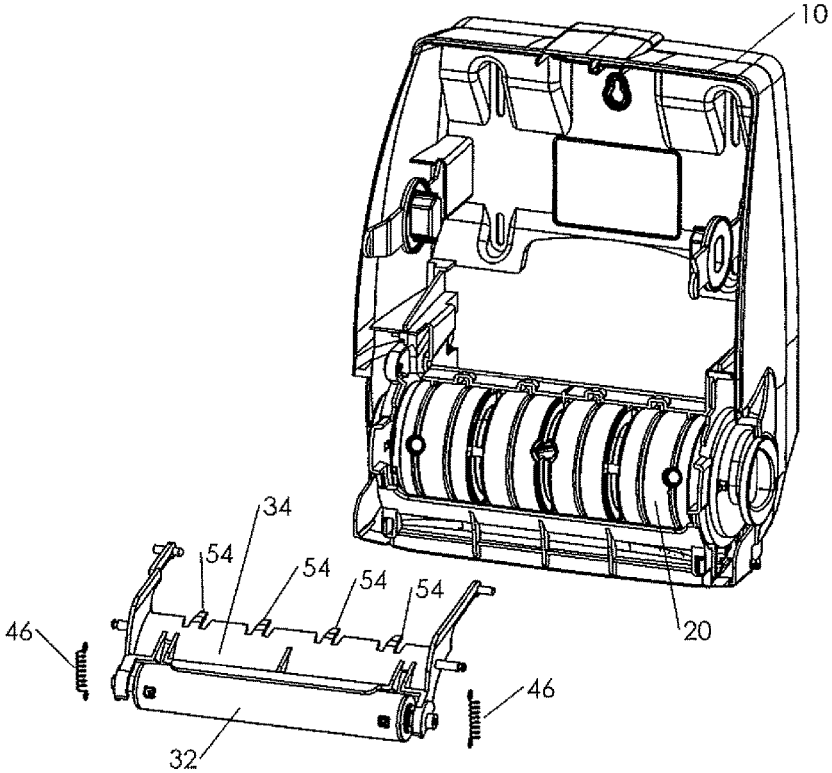
FIG. 6 is an exploded, perspective view of the structural components illustrated in FIG. 5.

FIGS. 2 and 4 illustrate the condition of the structural features of the damping assembly in the relative positions assumed thereby with respect to the toweling support roller at maximum damping when the plastic springs 54 are being flexed due to engagement with the fixed paper guide 58 at the location of recesses 42. Engagement is at an upper portion of the fixed paper guide defining the recesses 56.

The damping nip roller integrated into the pivoting paper guide 34 will dampen shock force that occurs when overspin slack is fully consumed. The integrated pivoting paper guide 34 and fixed paper guide 58 improve blade cutting by preventing accumulation of toweling wrinkles. This arrangement also creates nearly 270 degrees of wrap on the toweling support roller between nip roller 32 and a second nip roller adjacent to the inner end of the fixed paper guide 58 which further improves the ability to cut a variety of toweling types by reducing the chance for toweling slippage on the toweling support roller. A two stage spring action is incorporated by the use of coil springs and plastic springs and after initial damping begins plastic springs that are integrated into the pivoting paper guide engage a fixed mechanism (the lead end of the fixed paper guide) to apply additional spring force to the damping assembly as discussed above.

The invention claimed is:

1. Dispenser apparatus for dispensing paper toweling from a roll and for applying damping forces to the paper toweling when overspin shock is taken up during pulling of the paper toweling during dispensing, said dispenser apparatus comprising:

a housing;

a roll support connected to said housing for mounting the roll of paper toweling and permitting rotation of the roll of paper toweling during dispensing;

a rotatable toweling support roller spaced from said roll support receiving paper toweling from said roll of paper toweling and operable upon rotation to dispense said paper toweling;

a pivoting paper guide extending partially around said rotatable toweling support roller defining a paper path for the paper toweling about a portion of the rotatable toweling support roller;

a damping nip roller supported by said pivoting paper guide;

a spring structure operatively connected to said pivoting paper guide to exert a biasing force on said pivoting paper guide and form a nip between said damping nip roller and said rotatable toweling support roller accommodating the paper toweling, said pivoting paper guide and said damping nip roller moving away from said rotatable toweling support roller and providing a damping action when tensioning forces of predetermined magnitude are produced in the paper toweling between the damping nip roller and the rotatable paper toweling support roller during pulling of the paper toweling; and a curved fixed paper guide, said curved fixed paper guide positioned adjacent to the pivoting paper guide, said paper toweling forming a wrap about the rotatable toweling support roller extending under and beyond said curved fixed paper guide and said pivoting paper guide, said spring structure including a first spring structure connected to said pivoting paper guide and a second spring structure, said second spring structure being located at a location of interconnection between said pivoting paper guide and said curved fixed paper guide.

2. The dispenser apparatus according to claim 1 wherein said first spring structure includes at least one coiled spring.

3. The dispenser apparatus according to claim 2 wherein pivot pins spaced from said at least one coiled spring connect said pivoting paper guide to the housing.

4. The dispenser apparatus according to claim 1 wherein said second spring structure comprises at least one flexible plastic spring.

5. The dispenser apparatus according to claim 4 wherein said at least one flexible plastic spring is positioned in a recess defined by said curved fixed paper guide.

6. The dispenser apparatus according to claim 5 wherein said pivoting paper guide includes elongated members extending into engagement with said curved fixed paper guide, the distal end of at least one of said members comprising said at least one flexible plastic spring.

7. The dispenser apparatus according to claim 1 wherein said second spring structure is operable to exert a biasing force after a biasing force has been exerted by said first spring structure.

8. The dispenser apparatus according to claim 1 including a second nip roller spaced from the damping nip roller supported by said pivoting paper guide, said damping nip roller and said second nip roller defining the wrap, and the wrap being about 270 degrees about the rotatable toweling support roller.

* * * * *